US012104137B2

(12) United States Patent
Desai et al.

(10) Patent No.: US 12,104,137 B2
(45) Date of Patent: Oct. 1, 2024

(54) ENGINE OIL COMPOSITION

(71) Applicant: SHELL OIL COMPANY, Houston, TX (US)

(72) Inventors: Priyanka Subhash Desai, Houston, TX (US); Mark Clift Southby, London (GB)

(73) Assignee: Shell USA, Inc., Houston, TX (US)

( * ) Notice: Subject to any disclaimer, the term of this patent is extended or adjusted under 35 U.S.C. 154(b) by 0 days.

(21) Appl. No.: 18/040,165

(22) PCT Filed: Sep. 1, 2021

(86) PCT No.: PCT/EP2021/074141

§ 371 (c)(1),
(2) Date: Feb. 1, 2023

(87) PCT Pub. No.: WO2022/049130

PCT Pub. Date: Mar. 10, 2022

(65) Prior Publication Data

US 2023/0287292 A1 Sep. 14, 2023

Related U.S. Application Data

(60) Provisional application No. 63/073,171, filed on Sep. 1, 2020.

(51) Int. Cl.
*C10M 169/04* (2006.01)
*C10M 107/00* (2006.01)
(Continued)

(52) U.S. Cl.
CPC ..... *C10M 169/04* (2013.01); *C10M 107/00* (2013.01); *C10M 133/56* (2013.01);
(Continued)

(58) Field of Classification Search
CPC ..... C10M 169/04; C10M 107/00; C10M 133/56; C10M 141/00; C10M 2205/04;
(Continued)

(56) References Cited

U.S. PATENT DOCUMENTS 4,873,004 A 10/1989 Beverwijk et al.
5,512,192 A 4/1996 Lange et al.
(Continued)

FOREIGN PATENT DOCUMENTS

CA 3034737 A1 * 3/2018 ..... C08F 220/18
EP 0668342 A1 8/1995
(Continued)

OTHER PUBLICATIONS

International Search Report and Written Opinion Received for PCT Patent Application No. PCT/EP2021/074141, Mailed on Nov. 25, 2021, 10 Pages.
(Continued)

*Primary Examiner* — Cephia D Toomer
(74) *Attorney, Agent, or Firm* — Shell USA, Inc.

(57) ABSTRACT

The present invention provides an engine oil composition including 70 to 95 percent by weight of a base oil and 0.01 to 15 percent by weight of a dispersant comb polymer, based on the overall weight of the engine oil composition. The dispersant comb polymer consists of 13.7% by weight of a macromonomer, which is an ester of methacrylic acid and a hydroxylated hydrogenated polybutadiene with Mn of 4750 g/mol; 51.5% by weight of n-butyl methacrylate; 17.3% by weight of LMA; 11.2% by weight of styrene; 0.2% by weight of methyl methacrylate; and 6.10% by weight of N,N-dimethylaminoethyl methacrylate. The modified dispersant inhibitor package contains 30 wt % or less of succinimide type dispersant based on the overall weight of the modified dispersant inhibitor additive package, and the
(Continued)

engine oil composition has an SAE viscosity grade of 0W-X, wherein X is 30 or less.

5 Claims, 2 Drawing Sheets

(51) Int. Cl.

| | |
|---|---|
| ***C10M 133/56*** | (2006.01) |
| ***C10M 141/00*** | (2006.01) |
| *C10N 20/00* | (2006.01) |
| *C10N 20/02* | (2006.01) |
| *C10N 20/04* | (2006.01) |
| *C10N 30/00* | (2006.01) |
| *C10N 30/02* | (2006.01) |
| *C10N 30/04* | (2006.01) |
| *C10N 40/25* | (2006.01) |

(52) U.S. Cl.
CPC ..... *C10M 141/00* (2013.01); *C10M 2205/04* (2013.01); *C10M 2205/06* (2013.01); *C10M 2205/173* (2013.01); *C10M 2209/084* (2013.01); *C10M 2215/28* (2013.01); *C10M 2217/023* (2013.01); *C10N 2020/02* (2013.01); *C10N 2020/04* (2013.01); *C10N 2020/071* (2020.05); *C10N 2030/02* (2013.01); *C10N 2030/04* (2013.01); *C10N 2030/54* (2020.05); *C10N 2040/25* (2013.01)

(58) Field of Classification Search
CPC ..... C10M 2205/06; C10M 2205/173; C10M 2209/084; C10M 2215/28; C10M 2217/023; C10M 2205/0206; C10M 169/044; C10N 2020/02; C10N 2020/04; C10N 2020/071; C10N 2030/02; C10N 2030/04; C10N 2030/54; C10N 2040/25; C10N 2030/06; C10N 2030/40
See application file for complete search history.

(56) References Cited

U.S. PATENT DOCUMENTS

| | | | |
|---|---|---|---|
| 5,565,130 | A | 10/1996 | Omeis et al. |
| 5,597,871 | A | 1/1997 | Auschra et al. |
| 6,008,164 | A | 12/1999 | Aldrich et al. |
| 6,059,955 | A | 5/2000 | Cody et al. |
| 6,083,888 | A | 7/2000 | Sutherland |
| 6,090,989 | A | 7/2000 | Trewella et al. |
| 6,103,099 | A | 8/2000 | Wittenbrink et al. |
| 6,332,974 | B1 | 12/2001 | Wittenbrink et al. |
| 6,420,618 | B1 | 7/2002 | Berlowitz et al. |
| 6,475,960 | B1 | 11/2002 | Berlowitz et al. |
| 6,506,297 | B1 | 1/2003 | Wittenbrink et al. |
| 6,599,864 | B1 | 7/2003 | Bertomeu |
| 6,610,636 | B2 | 8/2003 | Berlowitz et al. |
| 7,067,049 | B1 | 6/2006 | Baillargeon et al. |
| 7,473,347 | B2 | 1/2009 | Germaine |
| 8,067,359 | B2 | 11/2011 | Hayes et al. |
| 10,731,097 | B2 | 8/2020 | Schöller et al. |
| 10,920,164 | B2 | 2/2021 | Klein et al. |
| 11,214,752 | B2 | 1/2022 | Csihony et al. |
| 11,274,262 | B2 | 3/2022 | Sunahara et al. |
| 2005/0268539 | A1 | 12/2005 | Schwab et al. |
| 2008/0194443 | A1 | 8/2008 | Stohr et al. |
| 2010/0180492 | A1 | 7/2010 | Krull et al. |
| 2010/0190671 | A1 | 7/2010 | Stoehr et al. |
| 2011/0064564 | A1 * | 3/2011 | Kochan, Jr. ..... F04D 1/04 415/115 |
| 2011/0306533 | A1 | 12/2011 | Eisenberg et al. |
| 2016/0097017 | A1 | 4/2016 | Eisenberg et al. |
| 2017/0009180 | A1 | 1/2017 | Chen et al. |
| 2018/0134983 | A1 | 5/2018 | Broutin et al. |
| 2018/0223214 | A1 | 8/2018 | Shamszad et al. |
| 2018/0334636 | A1 | 11/2018 | Hoshino et al. |
| 2019/0203143 | A1 | 7/2019 | Hussain et al. |
| 2019/0233757 | A1 | 8/2019 | Schimossek et al. |
| 2019/0292478 | A1 | 9/2019 | Hussain et al. |
| 2019/0292479 | A1 | 9/2019 | Hussain et al. |
| 2019/0300808 | A1 | 10/2019 | Sondjaja et al. |
| 2019/0367836 | A1 | 12/2019 | Yuki et al. |
| 2020/0010774 | A1 | 1/2020 | Oki |
| 2020/0224116 | A1 | 7/2020 | Schöller et al. |

FOREIGN PATENT DOCUMENTS

| | | | |
|---|---|---|---|
| EP | 0776959 | A2 | 6/1997 |
| JP | 2017101211 | A1 * | 6/2017 |
| JP | 2018177997 | A | 11/2018 |
| JP | 2019151766 | A | 9/2019 |
| WO | 2004085580 | A1 | 10/2004 |

OTHER PUBLICATIONS

Tan et al., "Impact of Viscosity Index Improvers (VII) on the Formation of Piston Deposits in Fuel Economy Engine Oils", SAE Technical Paper, 2019, 6 Pages.
Lauterwasser et al., "Megatrend Fuel Economy: How to Optimize Viscosity With VI Improvers", SAE Technical Paper, Feb. 1, 2016, 9 Pages.
Jaso,"Automobile Gasoline Engine Oils—Motored Fuel Economy Test Procedure" Society of Automotive Engineers of Japan, Inc. Standards Committee Deliberation, Apr. 1, 2019, 5 Pages.
Stöhr et al., "A New Generation of High Performance Viscosity Modifiers Based on Comb Polymers", SAE International, 2008, vol. No. 1, Issue No. 1, pp. 1511-1516.
Anon, "Multi-graded Diesel Engine Oils Use a Polymethacrylate VI Improver", Fluid & Lubricant Ideas, 1983, vol. No. 6, Issue No. 4, pp. 10-11.

* cited by examiner

ENGINE OIL COMPOSITION

CROSS REFERENCE TO RELATED APPLICATIONS

This is a National stage application of International Application No. PCT/EP2021/074141, filed 1 Sep. 2021, which claims priority of U.S. provisional Application No. 63/073,171, filed 1 Sep. 2020 which is incorporated herein by reference in its entirety.

FIELD OF THE INVENTION

The invention relates to engine oil compositions and, in particular, to engine oil compositions providing improved fuel economy.

BACKGROUND OF THE INVENTION

The formulation of an engine oil is often a balance between the positive effects of certain additives and base oils, and their limitations. There is an on-going demand to increase fuel economy in all types of vehicles and part of the solution to this may be found in improving the engine oil used.

Lower viscosity engine oils, in general, lead to increased fuel economy. However, there is a limit to the reduction in viscosity that is possible while maintaining a suitable lubricant film thickness. Without a suitable lubricant film thickness, increased wear will occur, leading to material fatigue and ultimately a shorter lifetime for the machinery in use.

Increasing the viscosity index (VI) of a lubricant can lead to improved fuel economy. The VI of a lubricant is a method of measuring the temperature dependence of the viscosity of a lubricant. A high viscosity index indicates a lower temperature dependence of the change in viscosity.

An increase in the viscosity index at constant viscosity at a particular temperature means that the viscosity is less at lower temperatures than for a comparable lubricant with a lower viscosity index.

Another important parameter for engine oils is the High Temperature High Shear (HTHS) viscosity. HTHS viscosity is an indication of the engine oil viscosity under severe engine operating conditions of high engine speeds or shear rates and high temperatures. It gives the temporary viscosity loss of a lubricant under conditions of high shear and elevated temperatures representative of typical engine operation. The lower the HTHS viscosity of an oil, the higher the anticipated fuel economy benefits. The ASTM D4683 standard HTHS viscosity is measured by tapered bearing simulator at a high temperature of 150° C. and shear rate of $1 \cdot 10^6\ s^{-1}$. Test method ASTM D6616 also measures the HTHS viscosity, but at lower temperatures of 100° C. and 80° C., more representative of bearing conditions in automotive engines operating in this temperature range.

A reduction in the engine oil viscosity grade according to the J300 specification results in lower viscosity values for kinematic viscosity (KV) at 100° C. (measured at low shear rates) and HTHS viscosity at 150° C. While beneficial for fuel economy, if HTHS 150° C. is not controlled it may result in poor engine protection leading to reduced engine life and sustained damage.

Viscosity index improvers (VIIs), also known as viscosity modifiers (VMs), are well known in the art to increase the fluid viscosity at high temperatures. Typical VMs include olefinic copolymer type, polymethacrylates, styrene-hydrogenated diene block and star polymers and are referred to as conventional VMs. Some viscosity index improvers have been specifically designed to provide the necessary HTHS 150° C. performance required at high temperatures and high shear rates for engine protection, while at the same time maintaining low or even zero viscosity increase at intermediate temperatures such as 80° C., 60° C. and 40° C. Comb viscosity index improvers, comprising a polymethacrylate main chain with substituted and/or un-substituted side chains, have been described in prior art and may provide lower HTHS viscosity values at temperatures 80° C. and 100° C. by ASTM 6616 for the same HTHS 150° C. performance by ASTM D4683 compared to their conventional hydrocarbon VM counterparts. A comparatively low value of HTHS80 and HTHS100 for the same HTHS150 performance is a key indicator of improved fuel economy performance.

Functionalised comb polymers, such as those described in US20160097017, US20110306533, US20100190671, US20080194443 and U.S. Pat. No. 5,597,871, may be used to provide one or more additional functions as well as viscosity index improvement. This may reduce the need to add further additives in a lubricant formulation or enhance certain performance characteristics like sludge or deposit control Typical engine oil formulations comprise a dispersant inhibitor (DI) package containing an ashless dispersant. The active components of the DI package normally comprise about 50 to 60 percent by weight of the ashless dispersant, the balance being comprised of other ingredients such as a detergent, an anti-wear agent, an antioxidant and various other minor additives. Examples of the typical components of a DI package are given in U.S. Pat. No. 5,512,192. The ashless dispersant is included in order to prevent varnish or sludge in the oil from depositing on the working surfaces of an engine. While this protection is desirable in an engine oil, typical ashless dispersants are considered particularly 'heavy' That is they demonstrate low VI characteristics and do not drop in viscosity or temporarily shear thin at high shear rates. Such dispersants, therefore, may detract from fuel economy improvements. Generally, fuel economy suffers with increased treat rate of the dispersant in engine oil formulations.

It is an objective of the present invention to provide an engine oil composition with increased fuel economy performance across a broad range of operating conditions.

SUMMARY OF THE INVENTION

Figure 1:
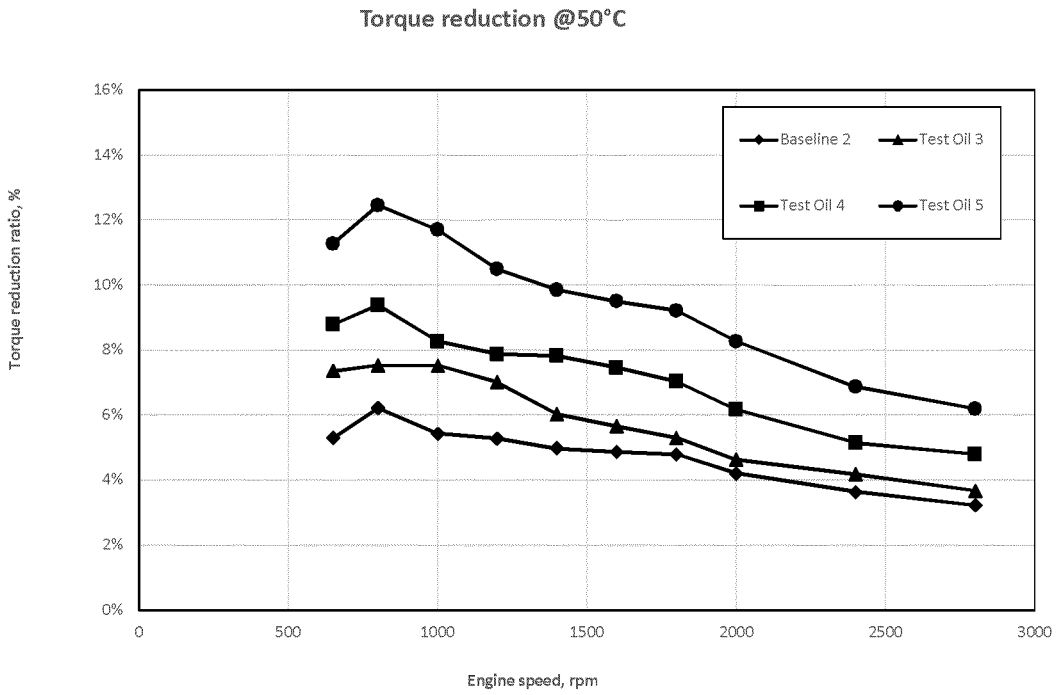
FIGS. 1 to 2 are graphs showing results of the Examples contained herein.

The present invention provides an engine oil composition comprising:

i) in the range from 70 to 95 percent by weight of a base oil, based on the overall weight of the engine oil composition;

ii) in the range of from 0.01 to 15 percent by weight of a dispersant comb polymer, based on the overall weight of the engine oil composition;

iii) in the range of from 4.99 to 15 percent by weight of a modified dispersant inhibitor additive package based on the overall weight of the engine oil composition, wherein the dispersant comb polymer consists of a. 13.7% by weight of a macromonomer, which is an ester of methacrylic acid and a hydroxylated hydrogenated polybutadiene with Mn of 4750 g/mol);
b. 51.5% by weight of n-butyl methacrylate;
c. 17.3% by weight of LMA;
d. 11.2% by weight of styrene;
e. 0.2% by weight of methyl methacrylate; and
f. 6.1% by weight of N,N-dimethylaminoethyl methacrylate;

wherein the modified dispersant inhibitor package contains 30 wt % or less of succinimide type dispersant based on the overall weight of the modified dispersant inhibitor additive package, and wherein the engine oil composition has an SAE viscosity grade of 0W-X, wherein X is 30 or less.

The present invention also provides the use of such an engine oil composition in the crankcase of an engine in order to reduce motored friction torque.

The present invention further provides the use of such an engine oil composition in the crankcase of an engine in order to improve fuel economy and viscosity properties.

DETAILED DESCRIPTION OF THE INVENTION

The present inventors have surprisingly found that an engine oil composition containing a specific dispersant comb polymer in combination with a modified dispersant inhibitor (DI) package with reduced ashless dispersant treat provides improved fuel economy characteristics. Said engine oil composition has been shown to lead to reduced motored friction torque in a motored friction engine test, viscosity index boost and improved HTHS100, HTHS80 and KV 40° C. viscosity characteristics at low temperatures, all of which are indicative of improved fuel economy across a range of operating temperatures.

The inventive engine oil composition comprises a base oil, a specific dispersant comb polymer and a modified DI package.

The base oil may be a single base oil or a blend of suitable base oils. Preferably, said base oil comprises one or more Fischer-Tropsch derived base oils. By the term "Fischer-Tropsch derived" is meant that a base oil is, or is derived from, a synthesis product of a Fischer-Tropsch process. A Fischer-Tropsch derived base oil may also be referred to as an XTL (X-to-Liquids) base oil. In the term "XTL", X stands for the source of the carbon atoms, e.g. gas to liquids (GTL), biomass to liquids (BTL).

Suitable Fischer-Tropsch derived base oils that may be conveniently used as the base oil in the lubricating composition of the present invention are those as for example disclosed in EP0776959, EP0668342, WO9721788, WO0015736, WO0014188, WO0014187, WO0014183, WO0014179, WO0008115, WO9941332, EP1029029, WO0118156 and WO0157166.

The term 'Fischer Tropsch derived base oil' used herein refers to a single base oil or a blend of base oils.

Typically, the Fischer-Tropsch derived base oil has a kinematic viscosity at 100° C. (as measured by ASTM D445) in the range of from 1 to 30 $mm^2/s$ (cSt), preferably from 1 to 25 $mm^2/s$ (cSt), and more preferably from 2 $mm^2/s$ to 12 $mm^2/s$. Preferably, the Fischer-Tropsch derived base oil has a kinematic viscosity at 100° C. (as measured by ASTM D445) of at least 2.5 $mm^2/s$, more preferably at least 3.0 $mm^2/s$.

In one embodiment of the present invention, the Fischer-Tropsch derived base oil comprises a Fischer Tropsch base oil having a kinematic viscosity at 100° C. of at most 5.0 $mm^2/s$, preferably at most 4.5 $mm^2/s$, more preferably at most 4.2 $mm^2/s$ (e.g. "GTL 4"). In another embodiment of the present invention, the Fischer-Tropsch derived base oil comprises a Fischer Tropsch base oil having a kinematic viscosity at 100° C. of at most 8.5 $mm^2/s$, preferably at most 8 $mm^2/s$ (e.g. "GTL 8"). In a further embodiment of the invention, the Fischer Tropsch derived base oil comprises a Fischer Tropsch base oil having a kinematic viscosity at 100° C. of at most 3.0 $mm^2/s$, preferably at most 2.8 $mm^2/s$ (e.g. "GTL 3").

Further, the Fischer-Tropsch derived base oil typically has a kinematic viscosity at 40° C. (as measured by ASTM D445) of from 8 to 100 $mm^2/s$ (cSt), preferably from 10 to 50 $mm^2/s$.

The Fischer-Tropsch derived base oil preferably has a viscosity index (according to ASTM D 2270) in the range of from 100 to 200. Preferably, the Fischer-Tropsch derived base oil has a viscosity index of at least 125, preferably 130. Also it is preferred that the viscosity index is below 180, preferably below 150.

In the event the Fischer-Tropsch derived base oil contains a blend of two or more Fischer-Tropsch derived base oils, the above values apply to the blend of the two or more Fischer-Tropsch derived base oils.

In the embodiment of the invention that the base oil is a Fischer-Tropsch derived base oil, the base oil preferably comprises 80 wt % or greater of Fischer-Tropsch derived base oil, based on the overall weight of the base oil. However, the engine oil composition may also comprise one or more other base oils in addition to the Fischer-Tropsch derived base oil. There are no particular limitations regarding the other base oil(s) used in engine oil composition according to the present invention, and various conventional mineral oils, synthetic oils as well as naturally derived esters such as vegetable oils may be conveniently used. Any base oil which belongs to Group I, Group II, Group III, Group IV, Group V and so on of the API (American Petroleum Institute) base oil categories, may be conveniently used, provided that the requirements in respect of the engine oil composition according to the present disclosure are met. Furthermore, the base oil may conveniently comprise mixtures of one or more mineral oils and/or one or more synthetic oils; thus, the term "base oil" may refer to a mixture comprising more than one base oil.

The total amount of base oil incorporated in the engine oil composition is in an amount in the range of from 65 to 95 wt %, more preferably in an amount in the range of from 65 to 90 wt % and most preferably in an amount in the range of from 75 to 88 wt %, with respect to the total weight of the lubricant composition.

The dispersant comb polymer used in the present invention consists of:

a. 13.7% by weight of a macromonomer, which is an ester of methacrylic acid and a hydroxylated hydrogenated polybutadiene with Mn of 4750 g/mol);
b. 51.5% by weight of n-butyl methacrylate;
c. 17.3% by weight of LMA;
d. 11.2% by weight of styrene;
e. 0.2% by weight of methyl methacrylate; and
f. 6.1% by weight of N,N-dimethylaminoethyl methacrylate.

Suitably, the weight-average molecular weight of the dispersant comb polymer is 560,000 g/mol.

The modified DI package comprises at least an antioxidant additive, an antiwear additive and a detergent additive. And may further comprise additional additives such as friction modifiers, pour point depressants, corrosion inhibitors, defoaming agents and seal fix or seal compatibility agents.

The detergent additive is suitably a metal containing detergent that contains calcium and/or magnesium as an alkaline earth metal. The content of the metal-containing detergent is preferably from 0.05 to 20 wt %, more preferably from 1.0 to 10.0 wt %, and further preferably from 2.0 to 5.0 wt %, in terms of alkaline earth metal content relative to the overall quantity of the engine oil composition.

It is preferable for the metal-containing detergent to contain a salicylate and/or a phenate and/or a carboxylate and/or a sulfonate as a primary component.

The antiwear additive in the modified DI package is suitably a zinc dialkyldithiophosphate. The content of the zinc dialkyldithiophosphate is preferably from 0.05 to 1.5 wt %, and more preferably from 0.4 to 1.4 wt %, based on the total weight of the engine oil composition. Additional or alternative anti-wear additives may be conveniently used in the composition of the present invention.

The antioxidant in the modified DI package is suitably a mixture of one or more phenolic antioxidants with one or more aminic antioxidants. The content of the antioxidants is preferably from 0.1 to 5.0 wt %, more preferably from 0.3 to 3.0 wt %, and most preferably from 0.5 to 1.5 wt %, based on the total weight of the engine oil composition.

Further non-comb polymethacrylates may be conveniently employed in the lubricating oil compositions of the present invention as effective pour point depressants.

Organo-molybdenum compounds such as molybdenum dialkyldithiocarbamate (MoDTC) may be conveniently employed as a friction modifier in the lubricating oil composition of the present invention.

Furthermore, compounds such as alkenyl succinic acid or ester moieties thereof, benzotriazole-based compounds and thiodiazole-based compounds may be conveniently used in the engine oil composition of the present invention as corrosion inhibitors.

Compounds such as polysiloxanes, dimethyl polycyclohexane and polyacrylates may be conveniently used in the engine oil composition of the present invention as defoaming agents.

Compounds which may be conveniently used in the engine oil composition of the present invention as seal fix or seal compatibility agents include, for example, commercially available aromatic esters.

Optionally, the modified DI package contains a succinimide type dispersant. It is an advantage of the present invention that the amount of succinimide type dispersant present in the DI package may be considerably reduced compared with the amount used in a typical engine oil package in which a viscosity modifier that was not a dispersant comb polymer consisting of 13.7% by weight of a macromonomer, which is an ester of methacrylic acid and a hydroxylated hydrogenated polybutadiene with Mn of 4750 g/mol); 51.5% by weight of n-butyl methacrylate; 17.3% by weight of LMA; 11.2% by weight of styrene; 0.2% by weight of methyl methacrylate; and 6.1% by weight of N,N-dimethylaminoethyl methacrylate, was used.

A typical industry standard DI additive package will contain at least 35 wt % of a succinimide type dispersant compound. The modified DI package of the present invention contains 30 wt % or less of succinimide type dispersant based on the overall weight of the modified DI additive package. In embodiments of the invention, the modified DI additive package may contain no more than 25 wt % or no more than 20 wt % or less of succinimide type dispersant based on the overall weight of the modified DI additive package.

A typical engine oil composition will contain at least 4 wt % of succinimide type dispersant based on the overall weight of the engine oil composition. In the present invention, the succinimide type dispersant is preferably present in an amount of no more than 3.5 wt %, more preferably no more than 3.2 wt %, based on the overall weight of the engine oil composition.

If the engine oil composition of the present invention comprises succinimide type dispersant, then the succinimide type dispersant is preferably present in an amount of at least 0.01 wt % based on the overall weight of the engine oil composition.

Preferably, the amount of the succinimide type dispersant present in the modified dispersant inhibitor package is an amount that is at least 50% less than that which would have been present if a viscosity modifier that was not a dispersant comb polymer consisting of 13.7% by weight of a macromonomer, which is an ester of methacrylic acid and a hydroxylated hydrogenated polybutadiene with Mn of 4750 g/mol); 51.5% by weight of n-butyl methacrylate; 17.3% by weight of LMA; 11.2% by weight of styrene; 0.2% by weight of methyl methacrylate; and 6.1% by weight of N,N-dimethylaminoethyl methacrylate, was used.

If present, the ashless dispersant is suitably selected from among the group consisting of a boronated or non-boronated alkylsuccinimide or alkenylsuccinimide, a boronated or non-boronated alkylsuccinic acid ester or alkenylsuccinic acid ester, a boronated or non-boronated alkylsuccinic acid imide or alkenylsuccinic acid imide, a boronated or non-boronated alkylsuccinic acid amide or alkenylsuccinic acid amide, or an arbitrary combination thereof.

Examples of ashless succinic acid imide dispersing agents and boron-modified ashless succinic acid imide dispersing agents include the substances listed below. Examples of succinic acid imide dispersing agents include nitrogen-containing compounds such as alkenyl group-containing or alkyl group-containing succinic acid imides derived from polyolefins, benzylamine, polyamines and Mannich bases. In addition, the succinic acid imide dispersing agent can be a derivative obtained by causing a phosphorus compound, such as thiophosphoric acid or a thiophosphate, an organic acid, a hydroxypolyoxyalkylene carbonate, or the like, to act on these nitrogen-containing compounds. Examples of boron-modified ashless succinic acid imide dispersing agents include derivatives obtained by causing a boron compound such as boric acid or a borate to act on these nitrogen-containing compounds.

The dispersing agent in the present embodiment should be constituted from a single dispersing agent arbitrarily selected from among those listed above, or two or more types thereof. Moreover, it is particularly preferable for the ashless dispersing agent to be a bis type polybutenyl succinic acid imide, a derivative of a bis type polybutenyl succinic acid imide, or a mixture thereof.

Here, the alkenyl groups and alkyl groups mentioned above may be straight chain or branched chain. Specifically, the alkenyl groups and alkyl groups are alkenyl groups and alkyl groups derived from oligomers of olefins such as propylene, 1-butene and isobutylene and co-oligomers of ethylene and propylene. It is preferable for branched chain alkyl groups and branched chain alkenyl groups to be derived from a polyisobutene, which is a type of polybutene, having a number average molecular weight of 500-5000, more preferably 700-4000, and further preferably 900-3000.

The molecular weights of polymer additives can be obtained by, for example, using a Shodex GPC-101 high performance liquid chromatography apparatus manufactured by Showa Denko Kabushiki Kaisha, setting a temperature of 40° C., using a differential refractive index (RI) detector as a detector, using THF as a carrier gas at a flow rate of 1.0 ml/min (Ref 0.3 ml/min), setting the sample injection quantity to be 100 μL, using a combination of {KF-G (Shodex)×1 and KF-805L (Shodex×2)} as a column, using a range that corresponds to the peak molecular weight, and calculating the average molecular weight (weight average molecular weight and number average molecular weight in terms of polystyrene).

The weight average molecular weight of the ashless dispersing agent is preferably from 1000 to 20,000, more preferably from 1500 to 10,000, and further preferably from 5000 to 10,000.

Typically, the modified DI package will also contain a suitable carrier fluid. The antioxidant additive, antiwear additive, detergent additive and, if present, the succinimide based dispersant and any other additives will be dispersed in said carrier fluid prior to being added to the base oil. Said carrier fluid is typically a base oil, such as a Group 1 type mineral oil.

The engine oil composition of the present invention has an SAE viscosity grade of 0W-X, wherein X is 30 or less. Suitably, X may be 30, 20, 12, 8 or 4. Preferably, X is 20 or less.

To facilitate a better understanding of the present invention, the following examples of certain aspects of some embodiments are given. In no way should the following examples be read to limit, or define, the entire scope of the invention.

EXAMPLES

Example 1

Fully formulated engine oils of viscosity grade SAE 0W-20 were blended according to Table 1. The amounts of the components are given in wt %, based on the total weight of the compositions.

The components used are as follows:

GTL 4—Fischer-Tropsch derived base oil having a kinematic viscosity at 100° C. (ASTM D445) of approximately 4 cSt, which may be conveniently prepared by the process described in WO02070631.

Full DI package 1—Full SAPS additive package containing an antiwear additive, a detergent, a non-succinimide type dispersant and an antioxidant, plus a polyisobutylene succinimide dispersant present in an amount to provide 5.5 wt % of said dispersant based on the whole engine oil composition.

Modified DI Package 1—The same additive package as Full DI package 1, except that it contains no polyisobutylene dispersant.

Modified DI package 2—The same additive package as Full DI package 1, except that it contains a polyisobutylene succinimide dispersant present in an amount to provide 2.75 wt % of said dispersant based on the whole engine oil composition.

Viscoplex 3-201—Viscosity modifier commercially available from Evonik.

Dispersant comb polymer—dispersant comb polymer consisting of 13.7% by weight of a macromonomer, which is an ester of methacrylic acid and a hydroxylated hydrogenated polybutadiene with Mn of 4750 g/mol); 51.5% by weight of n-butyl methacrylate; 17.3% by weight of LMA; 11.2% by weight of styrene; 0.2% by weight of methyl methacrylate; and 6.1% by weight of N,N-dimethylaminoethyl methacrylate.

Viscoplex 1-180—Poly alkyl methacrylate pour point depressant commercially available from Evonik.

TABLE 1

| Component | Baseline 1 | Test Oil 1 wt % | Test Oil 2 |
|---|---|---|---|
| GTL 4 | 80.9 | 79.3 | 79.25 |
| Full DI Package 1 | 12.5 | — | — |
| Modified DI package 1 | — | 7 | — |
| Modified DI package 2 | — | — | 9.75 |
| Viscoplex 3-201 | 6.4 | — | — |
| Dispersant comb polymer | — | 13.5 | 11 |
| Viscoplex 1-180 | 0.2 | 0.2 | 0.2 |

Rheological properties were tested with the following industry standard tests. Kinematic viscosity (KV) in centistokes (cSt) at 100° C. and 40° C. and Viscosity Index (VI) as measured by ASTM D445. HTHS150 is the high temperature high shear viscosity at temperature of 150° C., in centipoise (cP), measured by ASTM D4683. HTHS100 and HTHS80 are the high temperature high shear viscosities at temperature 100° C. and 80° C. respectively, in centipoise (cP), as measured by ASTM D6616.

The Hot Tube Test is a laboratory screener test developed to simulate high temperature piston deposit formation in the ASTM Sequence IIIG engine test and rank oils for the weighted piston deposit formation tendency. The Hot tube deposit test provides a good correlation with gasoline piston deposit formation in the ASTM Sequence IIIG engine test. In this test, vacuum suction pulls oil from a small bulk reservoir maintained at 150° C. into a hot glass tube heated to 275° C. Oil is pulled inside the tube every 60 seconds, for a residence time of 2-3 seconds over a period of 6 hours. This action creates conditions for the thin oil film inside the hot tube to oxidize and form deposits. At the end of 6 hours, an optical 'in-situ' deposit merit rating is assigned to the tube as per the Sequence IIIG rating procedure on a scale of 10 to 1. A rating of 10 indicates a clean tube with no deposit formation, while a rating of 1 indicates excessive deposit formation.

The results of all of these measurements are given in Table 2.

TABLE 2

| | | Baseline 1 | Test Oil 1 | Test Oil 2 |
|---|---|---|---|---|
| KV40° C. | $mm^2/s$ | 33.3 | 25.4 | 28.1 |
| KV100° C. | $mm^2/s$ | 7.6 | 7.0 | 6.84 |
| VI | | 208 | 263 | 218 |
| HTHS 150° C. | mPas | 2.62 | 2.63 | 2.64 |
| HTHS 100° C. | mPas | 5.37 | 4.33 | 4.71 |
| HTHS 80° C. | mPas | 7.95 | 6.38 | 6.99 |
| Hot Tube merits [275° C. 6 hours ] | | 9.6 | 6.6 | 9.0 |

These results show an improvement in VI for the candidate oils compared to the baseline oil. While all of the oils are thickened to the same HTHS150, the candidate oils which contain the dispersant comb polymer, showed an improvement in the HTHS100 and HTHS80 values compared to the baseline formulation blended using a commercial non-functionalized COMB VM VP 3-201. This Example shows that engine oils containing the dispersant comb polymer and reduced levels of dispersant provide improved low temperature viscosities and viscosity index compared to a baseline oil containing a standard comb viscosity modifier and a full DI package. Good results for the Hot Tube test were achieved even with a reduction in dispersant, with excellent results demonstrated for Test Oil 2.

Example 2

Four fully formulated engine oils of viscosity grade SAE 0W-12 were blended according to Table 3 The amounts of the components are given in wt %, based on the total weight of the compositions.

The following components were used in Example 2: GTL 4—Fischer-Tropsch derived base oil having a kinematic viscosity at 100° C. (ASTM D445) of approximately 4 cSt, which may be conveniently prepared by the process described in WO02070631.

GTL 3—Fischer-Tropsch derived base oil having a kinematic viscosity at 40° C. (ASTM D445) of approximately 9.8 cSt, which may be conveniently prepared by the process described in WO02070631.

Full DI package 2—Additive package containing an anti-wear additive, a detergent, a non-succinimide type dispersant and an antioxidant, plus a polyisobutylene succinimide dispersant present in an amount to provide 5.74 wt % of said dispersant based on the whole engine oil composition.

Modified DI package 3—The same additive package as Full DI package 2, except that it contains no polyisobutylene dispersant.

Modified DI package 4—The same additive package as Full DI package 2, except that it contains a polyisobutylene succinimide dispersant present in an amount to provide 2.87 wt % of said dispersant based on the whole engine oil composition.

Viscoplex 3-201—Viscosity modifier commercially available from Evonik.

Dispersant comb polymer—dispersant comb polymer consisting of 13.7% by weight of a macromonomer, which is an ester of methacrylic acid and a hydroxylated hydrogenated polybutadiene with Mn of 4750 g/mol); 51.5% by weight of n-butyl methacrylate; 17.3% by weight of LMA; 11.2% by weight of styrene; 0.2% by weight of methyl methacrylate; and 6.1% by weight of N,N-dimethylaminoethyl methacrylate.

As shown in table 3, Test Oil 3 (comparative) is formulated with the dispersant comb polymer and a non-modified DI package. Test Oil 4 is formulated with the dispersant comb polymer and a modified DI package containing 50% wt less ashless dispersant in said modified DI package compared with the non-modified DI package. Test Oil 5 contains the same dispersant comb polymer but with a modified DI package containing 0% wt of the ashless dispersant compared with the non-modified DI package. The baseline 0W-12 oil is formulated with a non-modified DI package and VP 3-201 as the viscosity modifier.

TABLE 3

Composition of Baseline and test oils

| Component | Baseline 2 | Test Oil 3 (comp. ) | Test Oil 4 | Test Oil 5 |
|---|---|---|---|---|
| | wt % | | | |
| GTL 4 | 57.50 | 57.00 | 53.00 | 55.00 |
| GTL 3 | 24.63 | 24.63 | 28.3 | 26.39 |

TABLE 3-continued

Composition of Baseline and test oils

| Component | Baseline 2 | Test Oil 3 (comp. ) | Test Oil 4 | Test Oil 5 |
|---|---|---|---|---|
| | wt % | | | |
| Full DI package 2 | 15.87 | 15.87 | — | — |
| Modified DI package 3 | — | — | — | 10.11 |
| Modified DI package 4 | — | — | 13.00 | — |
| Viscoplex 3-201 | 2.00 | — | — | — |
| Dispersant comb polymer | — | 2.50 | 5.70 | 8.50 |

Rheological properties for each of the oils in Table 3 were measured and the results are set out in Table 4.

TABLE 4

| | | Baseline 2 | Test Oil 3 | Test Oil 4 | Test Oil 5 |
|---|---|---|---|---|---|
| Kin. Visc. (ASTM D-445) | 40° C. $mm^2/s$ | 26.44 | 26.47 | 23.22 | 20.78 |
| Kin. Visc. (ASTM D-445) | 100° C. $mm^2/s$ | 5.84 | 5.85 | 5.78 | 5.72 |
| Viscosity Index | — — | 174 | 175 | 210 | 244 |
| HTHS (ASTM D-4683) | 150° C. mPas | 2.01 | 2.05 | 2.07 | 2.06 |
| HTHS (ASTM D-6616) | 80° C. mPas | 6.30 | 6.40 | 5.80 | 5.50 |

Example 3

Motored Fuel Economy tests, as per the new JASO GLV-1 specification, the JASO M 365:2019 (Automobile gasoline engine oils—Motored Fuel Economy Test procedure), were run to measure the motoring friction torque and estimate percent fuel economy improvement for a number of Test Oils. This test estimates fuel economy improvement in operation under Japanese WLTC and European WLTC test cycles based on measured motoring friction torque at 50° C. and 80° C. In this test, the contribution of oil to fuel economy improvement is calculated based on the reduction in motoring friction torque for tested oils against a standard reference oil. This change in torque is confirmed before and after each test with a reference oil. The engine and test conditions used in the motoring torque tests are shown in Table 5.

TABLE 5

| | |
|---|---|
| Engine type | Nissan MR20DD 2.0 L L4 |
| Valve Train Type | DOHC |
| Engine Speed | 1600 rpm –> 1200 rpm –> 1000 rpm –> 800 rpm –> 650 rpm –> 1800 rpm –> 2000 rpm –> 2400 rpm –> 2800 rpm |
| Oil Temperature | 50 ± 1.0° C., 80 ± 1.0° C., |
| Coolant Temperature | 50 ± 1.0° C., 80 ± 1.0° C., |

Figure 2:
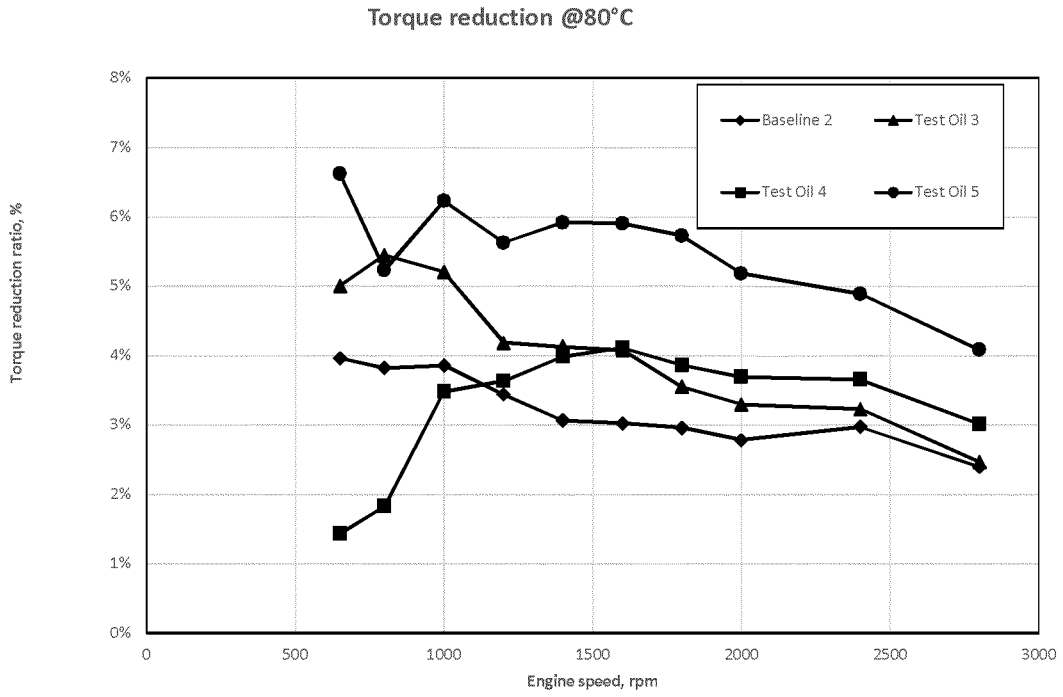

Motoring friction torque tests were conducted for the four 0W-12 candidates (baseline, Test Oil 3, Test Oil 4, Test Oil 5). FIGS. 1 and 2 show the rate of motoring friction torque reduction in the four oils in relation to the reference 0W-20 oil at 50° C. and 80° C., respectively. The dispersant comb polymer containing Test Oils 3, 4 and 5 show a bigger torque reduction than the baseline oil at both temperatures. These results demonstrate that the successive reduction in the ashless dispersant treat in the additive package which is allowed by the use of the dispersant comb polymer leads to an improvement in friction torque reduction.

Fuel economy improvement was estimated on the basis of the established correlation between motored and actual vehicle fuel economy test. Table 6 shows fuel economy improvement for the baseline and Test Oil candidates for two modes—1. LMH (low, medium, high speed) mode suited for Japanese real driving conditions or Japanese WLTC and 2. LMHExH (low, medium, high and extra high speed) mode to simulate European driving conditions or European WLTC.

TABLE 6

| | | Baseline 2 | Test Oil 3 | Test Oil 4 | Test Oil 5 |
|---|---|---|---|---|---|
| Fuel Economy Improvement - LMH Mode (Japan WLTC) | % | 0.78 | 0.98 | 1.07 | 1.50 |
| Fuel Economy Improvement - LMHExH Mode (European WLTC) | % | 0.75 | 0.93 | 1.01 | 1.41 |

These results show that the reduction in succinimide type dispersant allowed by the use of dispersant comb polymer of the present invention does indeed provide an improvement in fuel economy in actual vehicles.

We claim:

1. An engine oil composition comprising:

i) in the range of 70 to 95 percent by weight of a base oil, based on the overall weight of the engine oil composition;

ii) in the range of 0.01 to 15 percent by weight of a dispersant comb polymer, based on the overall weight of the engine oil composition;

iii) in the range of from 4.99 to 15 percent by weight of a modified dispersant inhibitor additive package based on the overall weight of the engine oil composition, wherein the dispersant comb polymer consists of a. 13.7% by weight of a macromonomer, which is an ester of methacrylic acid and a hydroxylated hydrogenated polybutadiene with Mn of 4750 g/mol;

b. 51.5% by weight of n-butyl methacrylate;

c. 17.3% by weight of LMA;

d. 11.2% by weight of styrene;

e. 0.2% by weight of methyl methacrylate; and f. 6.1% by weight of N,N-dimethylaminoethyl methacrylate;

wherein the modified dispersant inhibitor package contains 30 wt % or less of succinimide dispersant based on the overall weight of the modified dispersant inhibitor additive package, and wherein the engine oil composition has an SAE viscosity grade of 0W-X, wherein X is 30 or less.

2. The engine oil composition according to claim 1, wherein the base oil is a Fischer-Tropsch derived base oil.

3. The engine oil composition according to claim 1, wherein the succinimide dispersant is present in the modified dispersant inhibitor package at an amount that is at least 50% less than that which would have been present if a viscosity modifier that was not a dispersant comb polymer consisting of 13.7% by weight of a macromonomer, which is an ester of methacrylic acid and a hydroxylated hydrogenated polybutadiene with Mn of 4750 g/mol); 51.5% by weight of n-butyl methacrylate; 17.3% by weight of LMA; 11.2% by weight of styrene; 0.2% by weight of methyl methacrylate;

and 6.1% by weight of N,N-dimethylaminoethyl methacrylate, was used.

4. The engine oil composition according to claim 1, wherein the succinimide dispersant is present in an amount in the range of from 0.01 to 3.5 wt % of the engine oil composition.

5. The engine oil composition according to claim 1, wherein the succinimide dispersant is a polyolefin substituted succinimide dispersant.

* * * * *